US011254402B1

(12) United States Patent
Poirier et al.

(10) Patent No.: US 11,254,402 B1
(45) Date of Patent: Feb. 22, 2022

(54) METHOD AND SYSTEM FOR AUTOMATED LAUNCH CONTROL OF A MARINE VESSEL

(71) Applicant: Brunswick Corporation, Mettawa, IL (US)

(72) Inventors: Justin R. Poirier, Fond du Lac, WI (US); Andrew J. Przybyl, Berlin, WI (US); Chuck E. Welles, Rosendale, WI (US); Jason S. Arbuckle, Horicon, WI (US)

(73) Assignee: Brunswick Corporation, Mettawa, IL (US)

( * ) Notice: Subject to any disclaimer, the term of this patent is extended or adjusted under 35 U.S.C. 154(b) by 0 days.

(21) Appl. No.: 17/087,035

(22) Filed: Nov. 2, 2020

(51) Int. Cl.

| | |
|---|---|
| ***B63B 79/40*** | (2020.01) |
| ***B63H 21/14*** | (2006.01) |
| ***F02D 41/10*** | (2006.01) |
| ***B63B 32/10*** | (2020.01) |

(52) U.S. Cl.
CPC ..... *B63B 79/40* (2020.01); *B63B 32/10* (2020.02); *B63H 21/14* (2013.01); *F02D 41/10* (2013.01); *F02D 2200/101* (2013.01)

(58) Field of Classification Search
CPC ..... B63B 79/40; B63B 32/10; F02D 41/10; F02D 2200/101; B63H 21/14
See application file for complete search history.

(56) References Cited

U.S. PATENT DOCUMENTS

| | | | | |
|---|---|---|---|---|
| 4,558,769 | A * | 12/1985 | Neisen | B63H 23/30 192/3.31 |
| 6,485,341 | B1 | 11/2002 | Lanyi et al. | |
| 6,554,663 | B2 * | 4/2003 | Neisen | B63H 20/20 440/75 |
| 7,214,110 | B1 * | 5/2007 | Ehlers | B63H 21/14 440/1 |
| 7,361,067 | B1 | 4/2008 | Smedema | |
| 8,690,621 | B2 * | 4/2014 | Kuriyagawa | B63H 21/21 440/86 |
| 9,145,839 | B1 | 9/2015 | Andrasko | |
| 9,555,869 | B1 | 1/2017 | Arbuckle et al. | |
| 9,682,760 | B1 | 6/2017 | O'Brien et al. | |
| 10,343,758 | B2 | 7/2019 | Andrasko et al. | |
| 2005/0032605 | A1 * | 2/2005 | Booth | F16D 48/066 477/111 |

(Continued)

*Primary Examiner* — Joseph J Dallo
*Assistant Examiner* — Kurt Philip Liethen
(74) *Attorney, Agent, or Firm* — Andrus Intellectual Property Law, LLP

(57) ABSTRACT

A method of controlling propulsion for automated launch control includes receiving a user-selected command associated with wake surfing, accessing a predetermined RPM limit associated with the user-selected command, and automatically increasing rotational speed of a powerhead to accelerate the marine vessel to a vessel speed setpoint such that the rotational speed does not exceed the predetermined RPM limit. Once the marine vessel is traveling at the vessel speed setpoint, a cruising RPM value associated with the vessel speed setpoint is identified. A difference between the predetermined RPM limit and the cruising RPM value is determined, and then the predetermined RPM limit is adjusted to an adapted RPM limit based on the difference. The adapted RPM limit is then stored for use during a subsequent launch.

20 Claims, 6 Drawing Sheets

(56) References Cited

U.S. PATENT DOCUMENTS

| | | | | |
|---|---|---|---|---|
| 2007/0180941 | A1* | 8/2007 | Mowbray | B63H 20/20 74/335 |
| 2016/0096590 | A1* | 4/2016 | Brendel | B63B 1/32 114/285 |
| 2017/0137103 | A1* | 5/2017 | Ito | B63H 21/12 |
| 2017/0139426 | A1* | 5/2017 | Ito | B63B 79/10 |
| 2018/0314487 | A1* | 11/2018 | Lynema | B63H 21/21 |

* cited by examiner

METHOD AND SYSTEM FOR AUTOMATED LAUNCH CONTROL OF A MARINE VESSEL

FIELD

The present disclosure generally relates to systems and methods for automated launch control of a marine vessel, and more particularly to systems and methods for controlling rotational speed of a marine drive for automated launch control that optimizes launch for tow sports, such as wake surfing.

BACKGROUND

The following U.S. Patents provide background information and are incorporated herein by reference, in entirety.

U.S. Pat. No. 6,485,341 discloses a method for controlling the average speed of a vehicle over a predetermined time period, or indefinitely, or distance length based on a desired average speed, measuring an actual speed, and maintaining a cumulative error determined as a function of the difference between the average speed and actual speed and the time over which the actual speed measurement was taken. Based on the cumulative total of speed-time error, a compensatory speed is calculated that will reduce the cumulative speed-time error to an acceptable tolerance range within a selected period of elapsed time. Although particularly applicable to competition situations in which an average speed is dictated for use over a particular competition course, the average speed controlling method can be used in other situations where the average speed of a vehicle must be controlled.

U.S. Pat. No. 7,214,110 discloses an acceleration control system that allows the operator of a marine vessel to select an acceleration profile to control the engine speed of a marine vessel from an initial starting speed to a final desired speed. When used in conjunction with tow sports, such as wake boarding and water skiing, the use of acceleration profile provides consistent performance during the period of time when a water skier is accelerated from a stationary position to a full speed condition.

U.S. Pat. No. 7,361,067 discloses a system which stores data relating to the operation of a marine vessel during a water skier launch procedure. The data can include a plurality of throttle handle positions that are stored at a frequency which is suitable for reproducing the movement profile of the handle during a launch procedure. The water skier launch profile is then stored so that it can be recalled and reactivated to repeat the acceleration profile of the boat.

U.S. Pat. No. 9,145,839 discloses a method for controlling acceleration of a vehicle having an internal combustion engine that includes determining a first demand limit based on a smoke limit of the engine; determining a second demand limit based on a user-selected acceleration profile; retrieving a previous demand limit from a memory; and determining a third demand limit by adding a predetermined step quantity to the previous demand limit. The method further includes outputting the lesser of the first demand limit, the second demand limit, and the third demand limit as a subsequent demand limit. The method further includes controlling the engine with a control circuit to achieve the subsequent demand limit such that the vehicle accelerates from a speed associated with the previous demand limit to a speed associated with the subsequent demand limit.

U.S. Pat. No. 9,555,869 discloses a method for setting an engine speed of an internal combustion engine in a marine propulsion device of a marine propulsion system to an engine speed setpoint that includes determining the engine speed setpoint based on an operator demand and predicting a position of a throttle valve that is needed to achieve the engine speed setpoint. The method also includes determining a feed forward signal that will move the throttle valve to the predicted position, and after moving the throttle valve to the predicted position, adjusting the engine speed with a feedback controller so as to obtain the engine speed setpoint. An operating state of the marine propulsion system is also determined. Depending on the operating state, the method may include determining limits on an authority of the feedback controller to adjust the engine speed and/or determining whether the operator demand should be modified prior to determining the engine speed setpoint.

U.S. Pat. No. 9,682,760 discloses a method for setting an engine speed of an internal combustion engine in a marine propulsion device to an engine speed setpoint that includes receiving an operator demand from an input device and learning an adapted maximum engine speed. An engine speed setpoint is calculated by scaling the adapted maximum engine speed relative to the operator demand. The method includes predicting a position of a throttle valve of the engine that is needed to achieve the engine speed setpoint, and determining a feed forward signal that will move the throttle valve to the predicted position. A marine propulsion system has an electronic control unit that learns the adapted maximum engine speed, calculates the engine speed setpoint by scaling the adapted maximum engine speed relative to the operator demand, predicts the position of the throttle valve, and determines the feed forward signal that will move the throttle valve to the predicted position.

U.S. Pat. No. 10,343,758 discloses a method for controlling speed of a marine vessel that includes accelerating the marine vessel in response to a launch command. The method then includes holding the vessel speed at a desired vessel speed with a controller using feedback control. The controller phases in a derivative term of the feedback control in response to determining that the following conditions are true: (a) the vessel speed is within a given range of the desired vessel speed; and (b) an acceleration rate of the marine vessel is less than a given value.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In one embodiment, a method of controlling propulsion for automated launch control includes receiving a user-selected command associated with wake surfing, accessing a predetermined revolutions per minute (RPM) limit associated with the user-selected command, and automatically increasing rotational speed of a powerhead, such as an engine or motor, to the accelerate the marine vessel to a vessel speed setpoint such that the rotational speed does not exceed the predetermined RPM limit. Once the marine vessel is traveling at the vessel speed setpoint, a cruising RPM value associated with the vessel speed setpoint is identified. A difference between the predetermined RPM limit and the cruising RPM value is determined, and then the predetermined RPM limit is adjusted to an adapted RPM limit based on the difference. The adapted RPM limit is then stored for use during a subsequent launch.

An exemplary marine propulsion system includes a propulsion device configured to exert a propulsion force on a marine vessel, a user interface configured to receive at least one user-selected command for controlling launch of the marine vessel, and a control system. The control system is configured to receive a user-selected command associated with wake surfing, and to access a predetermined RPM limit based on the user-selected command. The control system automatically controls the propulsion device to increase rotational speed so as to accelerate the marine vessel to a vessel speed setpoint such that the rotational speed does not exceed the predetermined RPM limit. The control system detects that the marine vessel is traveling at the vessel speed setpoint and identifies a cruising rotational speed value associated therewith. The difference between the predetermined RPM limit and the cruising RPM value is determined and the predetermined RPM limit is adjusted to an adapted RPM limit based on the difference. The adapted RPM limit is stored for use during a subsequent launch.

Various other features, objects, and advantages of the invention will be made apparent from the following description taken together with the drawings.

BRIEF DESCRIPTION OF THE DRAWINGS

The present disclosure is described with reference to the following Figures.

DETAILED DESCRIPTION

Figure 1:
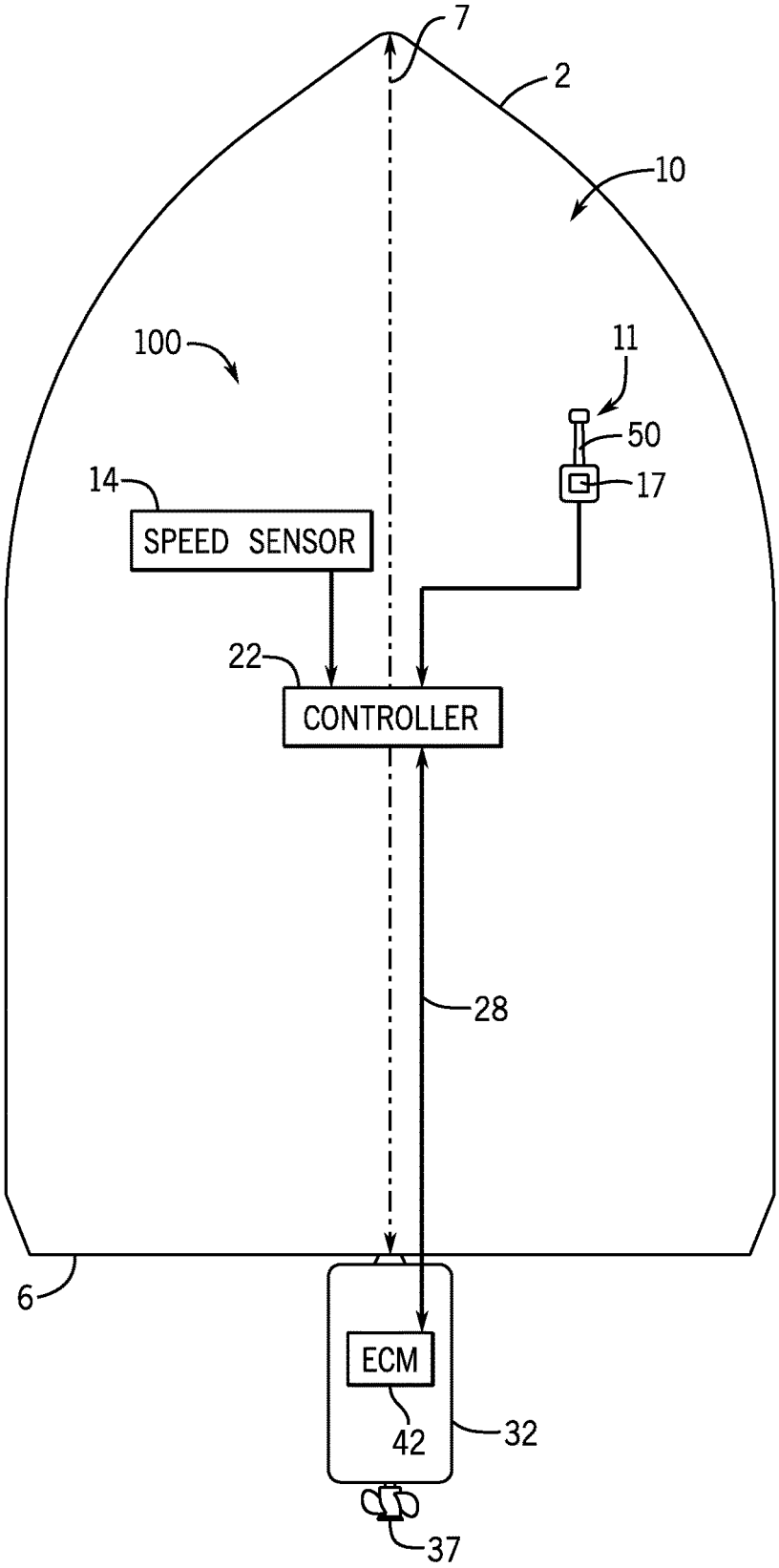
FIG. 1 depicts a marine propulsion system according to an embodiment of the present disclosure.

The present inventors have recognized problems with current propulsion control systems and particularly systems that implement automated launch for low-speed tow sports, such as wake surfing. The inventors have recognized that such systems tend to significantly overshoot target vessel speeds below 14 mph, which is typical for wake surfing, when aggressive launch profiles are implemented. The overshoot is due in large part to the failure by current launch control systems to account for vessel inertia and lags in speed control which are particularly problematic at lower vessel speeds during acceleration. For example, vessel speed and RPM often do not correlate at lower vessel speeds and during acceleration due to prop slip and the thrust needed to get the vessel moving through the water. This is particularly true during aggressive launches where the propulsion system is trying to quickly accelerate the vessel.

Overshooting the target speed is problematic for low-speed tow sports, particularly if the marine vessel gets on plane due to the speed overshoot. Wake surfing, in particular, cannot be conducted when the vessel is on plane and requires that the stern of the marine vessel ride low in the water in order to create the wave for wake surfing. Furthermore, overshooting and then slowing the marine vessel down significantly to the target is undesirable for tow sports and creates an unpleasant experience for the participant.

In view of the foregoing problems and challenges, the inventors developed the disclosed method and system for automated launch control of a marine vessel that learns and adapts an RPM limit based on RPM required to propel the marine vessel at the vessel speed setpoint. The adapted RPM limit is then used by the speed controller to accelerate the marine vessel as quickly as possible without overshooting the engine speed. For example, the engine speed can be accelerated at a predetermined RPM acceleration, such as based on a user-selected launch profile or a maximum RPM acceleration for the engine, straight to the adapted RPM limit and the engine can be maintained at that adapted RPM limit until the vessel speed reaches the vessel speed setpoint. Since the adapted RPM limit is determined based on the cruising RPM value learned for the marine vessel traveling at the vessel speed setpoint, significant overshoot in vessel speed does not occur.

For example, the disclosed launch control routine for wake surfing may be engaged upon receiving a user-selected command associated with wake surfing, such as a target speed setpoint associated with wake surfing and/or user engagement of a launch control mode wherein vessel propulsion is automatically controlled to bring the marine vessel up to a speed setpoint. The vessel speed is then held at the vessel speed setpoint until a user-instruction is received to disengage the hold, such as to slow the vessel down once the participant is no longer surfing. For example, the control system may be configured to engage the disclosed adaptive control algorithm for wake surfing when the launch control mode is selected and the target speed setpoint is between 8 and 15 miles per hour, which is a common and recommended speed range for wake surfing. The engine speed then monitored and controlled as described herein in order to adapt an RPM limit to minimize vessel speed overshoot during subsequent launches. In particular, a cruising RPM value associated with the marine vessel traveling at a vessel speed setpoint is identified and used to adjust and adapt the RPM limit.

The system may be preconfigured with a predetermined RPM limit associated with a vessel speed setpoint or other user-selected command associated with wake surfing, and that predetermined RPM limit can be adjusted and adapted over time based on the RPM behavior during sequential launches. Thereby, the automated launch control can be refined over sequential launches in order to provide improved behavior that adapts to the current vessel conditions, such as the weight of the vessel due to a number of passengers, a fill level of the ballasts, current and wave conditions, etc.

FIG. 1 illustrates a marine vessel 2 having a propulsion system 10 for controlling propulsion according to the present disclosure. The propulsion system 10 includes at least one propulsion device 32, and in some embodiments may include a plurality of propulsion devices configured and controlled as described herein. In the depicted embodiments, the propulsion device 32 is an outboard drive, or outboard motor, coupled to the transom 6 of the marine vessel 2. The propulsion device 32 may be an electric propulsion device containing an electric motor or a combustion-powered device containing an internal combustion engine. The propulsion device 32 is attached to the marine vessel 2 in a conventional manner such that each is rotatable about a respective vertical steering axis in order to steer the marine vessel 2. Often, the propulsion device is also rotatable about a horizontal trim axis in order to trim the propulsion devices up and down. In the examples shown and described, the propulsion device 32 is an outboard drive; however, the concepts of the present disclosure are not limited for use with outboard drives and can be implemented with other types of propulsion devices, such as stern drives, inboard drives, etc.

The propulsion device 32 includes a powerhead 33, which is a prime mover and may include a motor (such as an electric motor), an engine (such as an internal combustion engine), or a hybrid thereof. As described herein, rotational speed, or RPM, of the powerhead (whether an ICE or an electric motor) is controlled to provide improved launch control for wake surfing and other low-speed tow sports. The powerhead 33 initiates and maintains rotation of the drive shaft to thereby cause rotation of a propeller shaft having a propeller 37 at the end thereof, which will be understood as referring to a propeller or an impeller, or combination thereof. The propeller 37 is connected to and rotates with the propeller shaft propels the marine vessel 2. The direction of rotation of the propeller 37 is changeable by a gear system (e.g., a transmission), or in some embodiments by changing the directional rotation of the powerhead 33. The rotational direction of the propeller is typically controlled by a remote control 11 associated with the respective propulsion device 32. As is conventional, the remote control 11 includes a lever 50 movable by an operator into a reverse position to effectuate reverse propulsion, a neutral position that causes disassociation between the powerhead 33 and the propeller or otherwise no propulsion force, and a forward position that effectuates a forward propulsion. The remote-control lever 50 is also movable by an operator to provide throttle control, and thus thrust control, within the respective gear position. In a preferred embodiment, the remote control 11 is a drive-by-wire input device, and the position of the lever 50 sensed by the position sensor 17 will be translated into a control input to a throttle valve, for example. Such drive-by-wire systems are known in the art, an example of which is disclosed at U.S. Pat. No. 9,103,287 incorporated herein by reference in its entirety.

Referring to FIGS. 1 and 7, the propulsion system 10 includes a control system 100 that includes one or more controllers and communication networks for effectuating propulsion control during launch as described herein. Each propulsion device 32 may be associated with and controlled by an engine control module (ECM) 42 and a central controller 22, such as a helm control module (HCM) or command control module (CCM) communicatively connected to the ECM 42. As will be understood by an ordinary skilled person, in embodiments where the powerhead 33 is an electric motor or a hybrid electric motor, the ECM 42 will be configured accordingly. The connection between the HCM 22 and the ECM 42 is via a communication link 28, which may be by any known means and in various embodiments could be a CAN bus for the marine vessel (such as a CAN Kingdom network), a dedicated communication bus between the respective control modules 22 and 42, a wireless communication network via Bluetooth, BLE, ZigBee, or any other wireless protocol, or via other communication means implemented for facilitating communication between electronic devices on a marine vessel.

Figure 2:
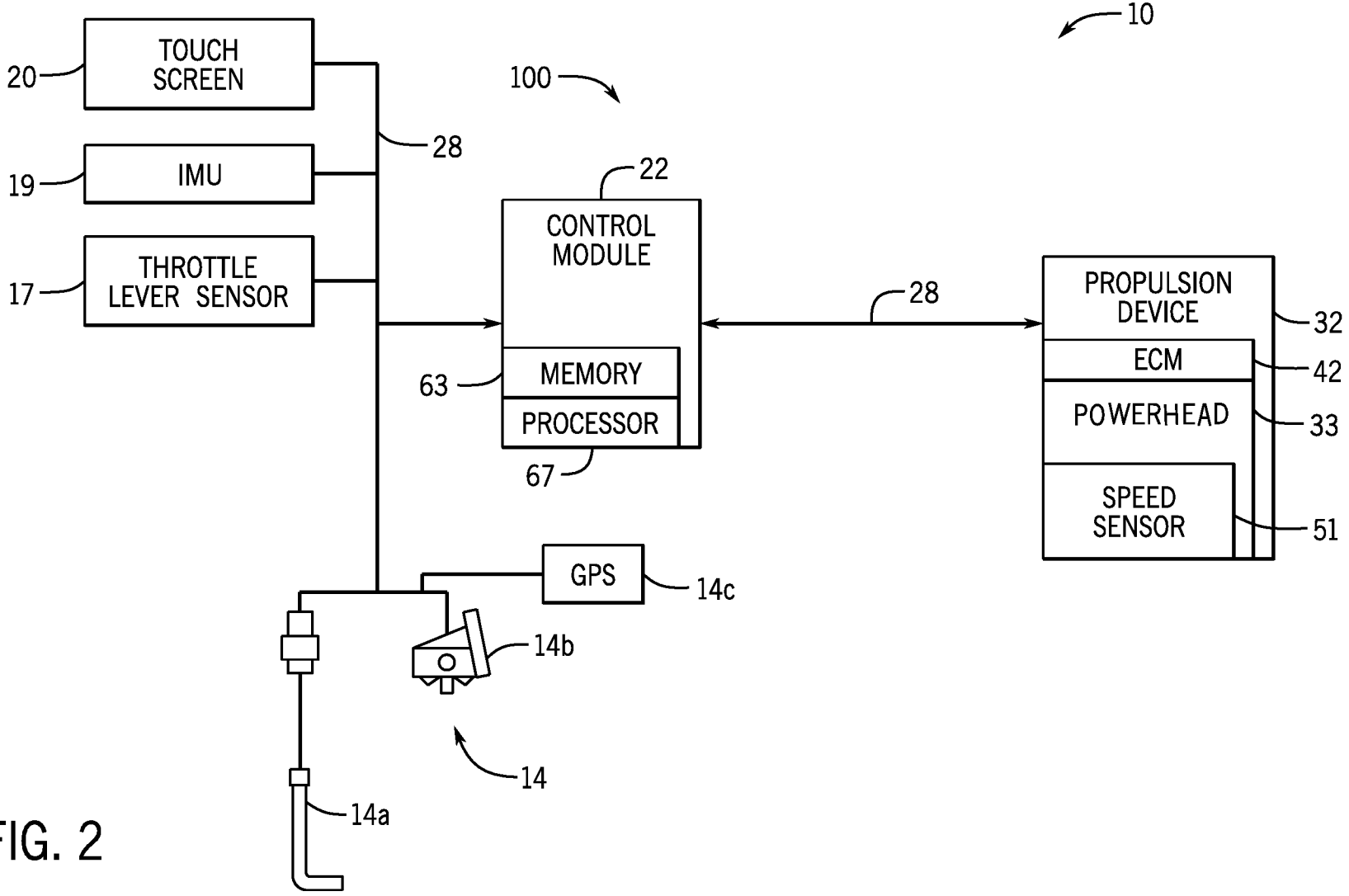
FIG. 2 is a schematic depicting another embodiment of a marine propulsion system according to the present disclosure.

Thereby, communication is facilitated between the controllers in the control system 100, whereby the ECM communicates engine parameters—e.g., engine state (stall, crank, or run), RPM, throttle position, transmission speed, etc.—and the HCM 22 (or other central controller) can communicate control instructions—e.g. output commands based (such as based on user inputs to control throttle, steering, and/or trim) and/or output restrictions. The HCM 22 may further be configured to carry out propulsion and vessel speed control methods, such as automatic vessel speed control, and including the methods described herein. The control system 100 arrangement depicted and described at FIGS. 1 and 2 is merely representative and various other arrangements are known and within the scope of the disclosure. For example, the control system 100 may further include additional or different controllers and/or controller types than those depicted, such as a powertrain control module (PCM) and/or a thrust vector module (TVM), as are well-known in the art. The methods described herein may be accomplished by any one controller or by cooperation of two more controllers within the control system 100 on the vessel 2.

Each of the controllers (HCMs, ECMs, etc.) may have a memory and a programmable processor, such as processor 67 and memory 63 in HCM 22. As is conventional, the processor 67 can be communicatively connected to a computer readable medium that includes volatile or nonvolatile memory upon which computer readable code (software) is stored. The processor 67 can access the computer readable code on the computer readable medium, and upon executing the code can send signals to carry out functions according to the methods described hereinbelow. Execution of the code allows the control system 100 to control one or more powerheads 33 and various other systems in or associated with each propulsion device 32. Processor 67 can be implemented within a single device but can also be distributed across multiple processing devices or sub-systems that cooperate in executing program instructions. Examples include general purpose central processing units, application-specific processors, and logic devices, as well as any other type of processing device, combinations of processing devices, and/or variations thereof. In the example shown, at least one HCM 22 comprises a memory 63 (such as, for example, RAM or ROM), although all of the control modules may comprise such storage.

The controller 22 may receive engine speed, or RPM, from the ECM 42. The engine speed may be sensed by the engine speed sensor 51, as is well known in the relevant art. The controller 22 may receive a vessel speed from vessel speed sensor 14. Alternatively or additionally, the control system 100 may receive input from a throttle lever sensor indicating throttle lever 50 position communicatively connected (e.g., via CAN bus 28) to one or more controllers 22. In the examples shown in FIGS. 1 and 2, the HCM 22 interprets these signals and sends commands to the ECMs. The vessel speed sensor 14 may be, for example, a pitot tube sensor **14*a*, a paddle wheel sensor 14*b*, or any other speed sensor appropriate for sensing the actual speed of the marine vessel. Alternatively or additionally, the vessel speed sensor 14 may be a GPS device 14*c*** that calculates vessel speed by determining how far the vessel has traveled in a given amount of time.

The controller 22 may also receive inputs from an inertial measurement unit (IMU) 19 that senses a roll position, yaw position, and pitch of the vessel 2. For example, the IMU 19 may comprise a gyroscope, such as a three-axis gyroscope, to detect orientation information that may be used to determine the roll, yaw, and pitch angles of the marine vessel 2. In other embodiments, the IMU 19 may be a magnetometer, or may include any other type of position or inertial measurement unit, such as a combination accelerometer and/or gyroscope with a magnetometer.

The touchscreen 20 display, or other user input device or system, can be used to receive user-selections and commands, including to select a launch profile and/or other launch control settings. This includes user-selection of a launch control mode based on which propulsion output and vessel speed are automatically controlled. Such launch control modes are known for various tow sport applications. Exemplary launch control methods and modes of operation are described at U.S. Pat. Nos. 6,485,341, 7,214,110, 7,361,067, 10,343,758, which are incorporated herein by reference in their entireties. As is typical, the user may select launch control mode and may then make a subselection designating a particular launch behavior, such as to select a stored launch profile. Here, the system 100 may be configured such that one or more "wake surfing" launch profiles or and/or a "wake surfing launch control" mode is available. The touchscreen display 20 may comprise part of a user interface system at the vessel helm. In one embodiment, the display 20 may comprise part of an on-board management system for the marine vessel 2, such as a VesselView® by Mercury Marine of Fond Du Lac, Wis. In various embodiments, the touchscreen 20 may be incorporated in a user interface system that further includes one or more input devices for facilitating user input, such as a keyboard, push buttons, etc.

Figure 3:
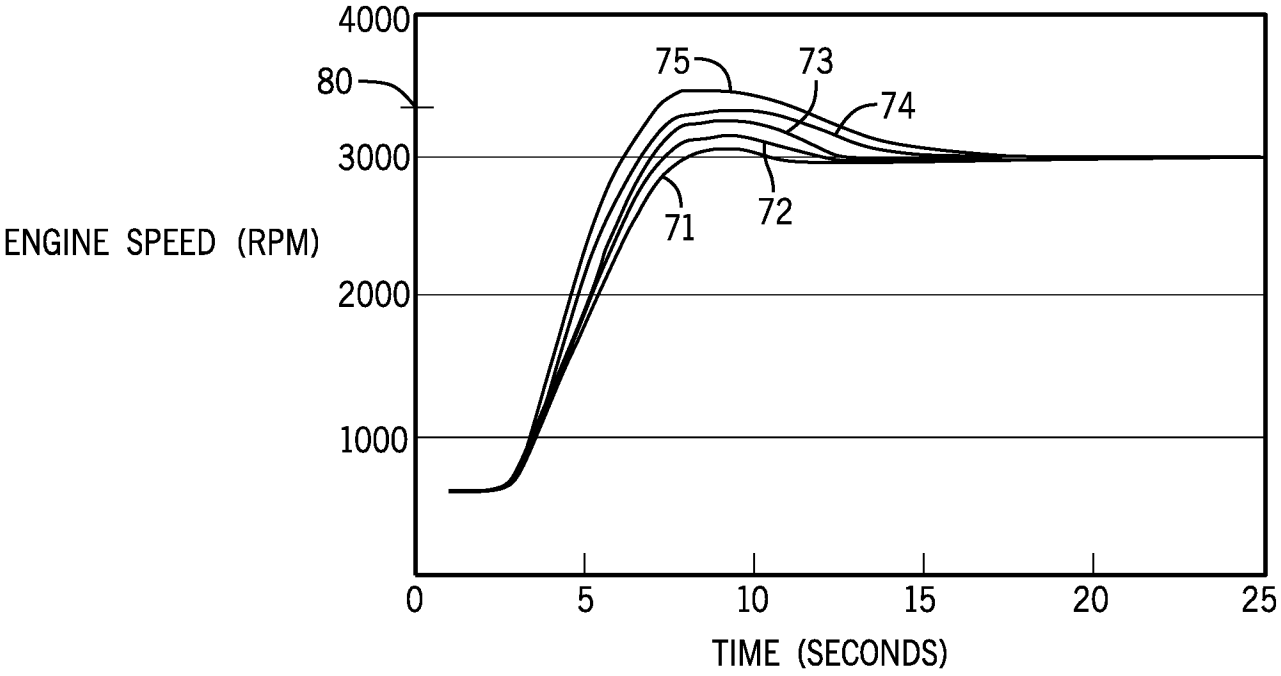
FIG. 3 depicts exemplary rotational speed profiles selectable for automated launch control.

Various launch profiles may be selectable to control the aggressiveness of the launch, meaning the rate at which the vessel is accelerated to reach a target speed setpoint. FIG. 3 exemplifies exemplary engine RPM behavior associated with five exemplary launch profiles 71-75. The launch profiles represent various launching patterns that range from at least aggressive launch profile 71 where the vessel is more gradually accelerated to the vessel speed setpoint, to a most aggressive launch profile 75 where the vessel is accelerated to the vessel speed setpoint as quickly as possible. Each launch profile may be associated with a predetermined RPM acceleration rate, where the RPM setpoint is increased at a predetermined rate until either the vessel speed reaches the vessel speed setpoint or the RPM reaches as RPM limit. Each launch profile may likewise be associated with a predetermined RPM limit, which may be adapted over multiple launches as described herein.

In one example, the user may select the launch control mode and/or launch profile and then may set a target speed setpoint to be automatically maintained by the system 100. As is known, wake surfing is typically conducted at vessel speeds between 8 and 15 mph, and more often between about 9 or 9.5 mph and 12 mph. Thus, where a vessel speed associated with wake surfing is selected, such as between 8 and 15 mph, or in certain embodiments between 9 mph and 12 mph, the system 100 may be configured to interpret the user-selected command (e.g., the target speed setpoint selection and/or engagement of the launch control mode) as a user-selected command associated with wake surfing. In certain embodiments, the system 10 may further be configured for user-selection of the adaptive speed control method described herein, where the adaptive features are only engaged upon user selection.

Referring again to FIG. 3, it can be seen that the more aggressive launch profiles, such as the fourth launch profile 74 and the fifth launch profile 75, result in greater overshoot beyond the cruising RPM value associated with the marine vessel traveling at the vessel speed setpoint, which in the depicted example is 3000 RPM. This overshoot in engine RPM corresponds with and leads to an overshoot in vessel speed. The more aggressive launch profiles lead to a more significant overshoot. As described above, it is desirable to reduce that overshoot, particularly for wake boarding launch control where speed overshoot can lead to undesirable consequences such as the marine vessel getting on plain and otherwise negatively impacting the experience of the wake surfer who is towed closely behind the marine vessel.

In certain embodiments, the control system 100 may implement the disclosed adapted RPM limit only for launches meeting an aggressiveness threshold where profiles or other parameters associated with a threshold acceleration, a threshold overshoot, or some other aggressiveness threshold are met. When the aggressiveness threshold is met, then the system 100 may automatically engage the adapted launch control routine.

Figure 4:
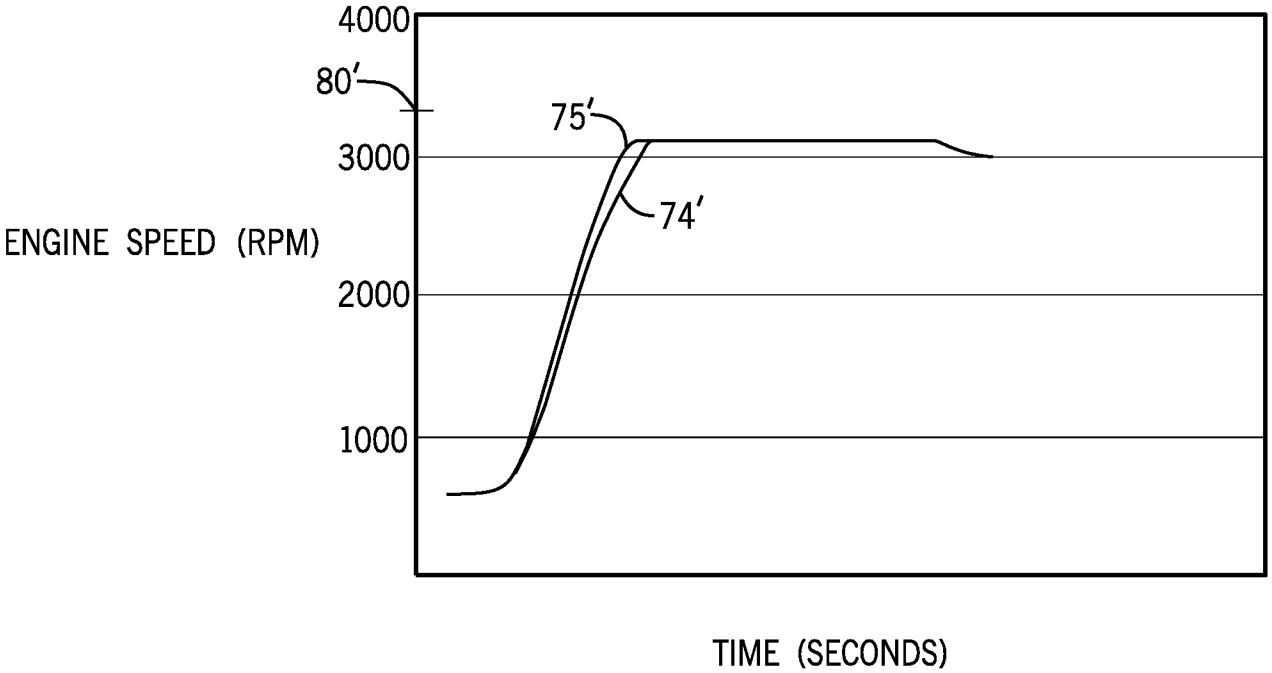
FIG. 4 is a graphical representation of rotational speed profiles selectable for launch control and providing adapted RPM limit control according to the present disclosure.

FIG. 4 depicts an example wherein two vessel profiles are shown implementing an adapted RPM limit for a propulsion device having an internal combustion engine. In the example, engine speed function 74 and engine speed function 75 implement an adapted engine RPM limit 80' that is closer to the cruising engine RPM value (3000 RPM in this example) than the initial predetermined RPM limit 80 exemplified in FIG. 3. The initial predetermined RPM limit may be an initial value set, for example, based on the user-selected command, such as based on the user-selected launch profile and/or the selected speed setpoint. The initial predetermined RPM limit may generally be a relatively high setpoint to accommodate various vessel configurations and vessel conditions to allow sufficient RPM in order to accelerate the marine vessel. That high initial predetermined RPM limit is then decreased over the course of sequential launches based on a learned cruising RPM for the vessel at the current conditions. Decreasing and adapting the RPM limit will decrease the overshoot that occurs for a subsequent launch.

In the example at FIG. 4, the predetermined RPM limit 80' is adapted to the particular marine vessel based on the cruising RPM value associated with the vessel speed setpoint. In the depicted example, the cruising engine RPM value is 3000, which is the RPM required to maintain the marine vessel under current conditions at the vessel speed setpoint. The adapted RPM limit 80' is determined based on difference between the initial predetermined RPM limit 80 or the last-determined RPM limit by the adapt algorithm and the cruising RPM value. That adapted RPM limit then becomes the predetermined RPM limit implemented in the subsequent launch. Thereby, the predetermined RPM limit is slowly adapted to become closer to the cruising RPM value.

FIG. 4 illustrates the behavior of the marine vessel for each of the adapted profiles 74' and 75' where the RPM does not exceed the adapted predetermined RPM limit 80'. The overshoot beyond the cruising RPM value, and thus the overshoot in vessel speed, is significantly reduced. In certain embodiments, the overshoot time period, which is a time period for which the RPM remains above the cruising RPM value, may increase because it may take longer for the marine vessel to reach the vessel speed setpoint when the RPM limit is decreased. However, the negative consequences of the vessel speed overshoot are minimized or eliminated.

The adapted RPM limit is determined based on a difference between the predetermined RPM limit 80 and the cruising RPM value. In various embodiments, the predetermined RPM limit may be a value determined based on a previous launch, such as the launch immediately prior to the current launch, or may be a preset value, such as a manufacturer-set value or a value set on system configuration. For each launch where adapt routines are provided, the adapted RPM limit is calculated once the vessel is maintained at the vessel speed setpoint. In certain embodiments, the predetermined RPM limit may reset after each key cycle such that the adapted launch control only accumulates for launches occurring within one key cycle. For example, the RPM limit may reset to the manufacturer-set or other initial predetermine RPM at key-off or key-on. In other embodiments, the adapted RPM limit may be stored between key cycles and RPM limit may be continually refined over the course of vessel use. In certain embodiments, an adapted RPM limit may be determined for each profile and/or each vessel speed setpoint such that various adapted RPM limits may be stored and automatically employed by the control system 100 based on the user-selected command associated with wake surfing. In such an embodiment, each of the profiles 74' and 75' in FIG. 4 may utilize a different adapted RPM limit, such as where the adapted RPM limit is slightly higher for more aggressive launch profiles.

The adapted RPM limit may be calculated in various ways based on the difference between the predetermined RPM limit and the cruising RPM value. To provide one example, the adapted RPM limit may be calculated as a percentage of the difference between the predetermined RPM limit (which again may be an initial predetermined value or a value adapted in a previous launch cycle) and the cruising RPM value. For instance, the adapted RPM limit may be calculated by subtracting 50% of the difference from the predetermined RPM limit. Thereby, the adapted RPM limit gradually approaches the cruising RPM value over a series of launches.

In another embodiment, the adapted RPM limit may be calculated by adjusting the predetermined RPM limit by a predetermined amount in the direction of the distance, wherein the predetermined amount is less than or equal to the distance. For example, where the difference between the predetermined RPM limit and the cruising RPM value is a positive number greater than or equal to the predetermined amount (i.e., predetermined RPM—cruising RPM>/=predetermined amount), a predetermined amount will be subtracted from the predetermined RPM limit. To further illustrate, if the predetermined engine RPM limit is 3600 RPM and the cruising engine RPM value is 3000 RPM, a predetermined amount, such as 50 RPM, is subtracted from the predetermined engine RPM limit to arrive at an adapted RPM limit of 3550 RPM for that launch cycle. This may continue over a series of launches, where the predetermined amount is subtracted from the predetermined RPM limit determined in the last launch, until the predetermined RPM limit is within the predetermined amount (e.g., 50 RPM) of the cruising engine RPM value.

In still other embodiments, a different method of calculating the adapted RPM limit based on the cruising RPM value may be employed. To provide just one additional example, the adapted RPM limit may be calculated as a predetermined amount above or a predetermined percentage greater than the cruising RPM value. In another embodiment, the adapted RPM limit may be set equal to the cruising RPM.

Figure 5:
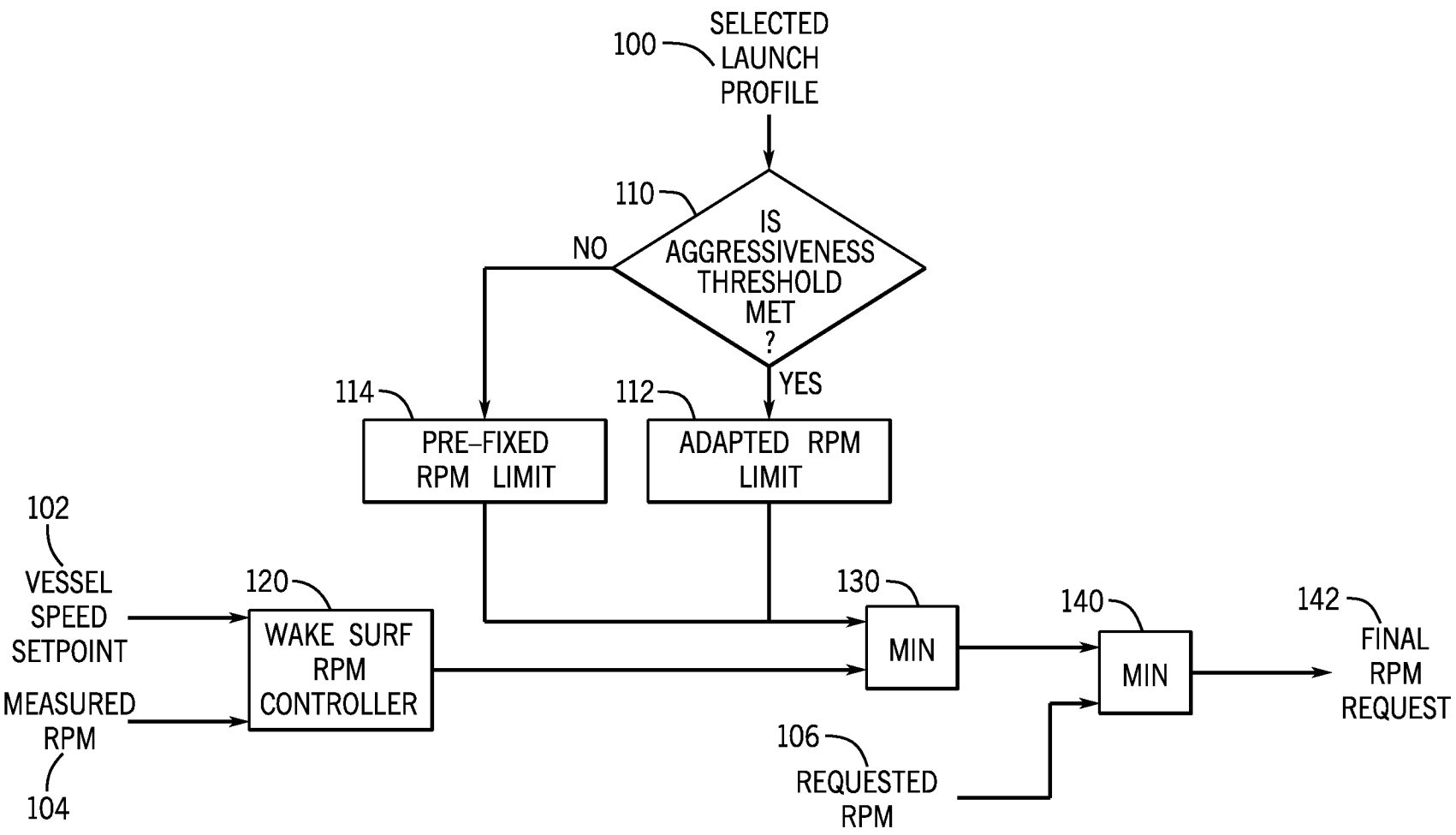
FIG. 5 is a flow diagram showing control logic according to one embodiment of the present disclosure.

FIG. 5 is a flow diagram showing exemplary control logic according to one embodiment of the present disclosure. Inputs are received, including a selected launch profile 100 and a vessel speed setpoint 102 (which may also be selected by a user or may result from the launch profile selection). Once launch is initiated, a measured RPM 104 is provided as an input, such as measured by speed sensor 51 measuring rotational speed of the powerhead 33 (e.g., engine speed or motor RPM). A requested RPM 106 is also provided as an input, which is generally a value calculated by standard acceleration control logic accounts for values related to engine or motor capability and a pre-set rate limit (maximum RPM increase per time period) for the propulsion system.

In certain embodiments, the RPM limit adaptation function described herein may be utilized for certain launches that meet an aggressiveness threshold. FIG. 5 illustrated exemplary logic, where a determination is made at step 110 whether an aggressiveness threshold is met. For example, certain launch profiles may be associated with the adapted RPM limit function, whereas for less aggressive launch profiles where overshoot is not a problem, a pre-fixed RPM limit 114 may be utilized. For example, the pre-fixed RPM limit 114 may be a static RPM limit associated with non-aggressive launch profile or other user-input a threshold acceleration, a threshold overshoot, or some other relevant value associated with a tendency for significant vessel speed overshoot for low-speed launch. The aggressiveness threshold may be met or associated with certain launch profiles. When the aggressiveness threshold is met at step 110, then the last-stored adapted RPM limit 112 associated with the vessel speed setpoint and/or launch profile is utilized as the predetermined RPM limit. If the aggressiveness threshold is not met at step 110, then the pre-fixed RPM limit 114 is utilized for the particular launch control routine.

Once launch is initiated, the wake surf RPM controller 120 calculates an RPM setpoint based on the vessel speed setpoint 102 and the measured RPM 104. For example, the wake surf controller may store or access a table providing RPM setpoints based on vessel speed setpoints and measured RPMs. The output of the wake surf RPM controller 120 is then compared to the predetermined RPM limit (either the pre-fixed RPM limit 114 or the adapted RPM limit 112) at the comparator 130, and the minimum of the two values is selected. As the input of the wake surfer RPM controller 120 reaches and exceeds the cruising RPM value, the adapted predetermined RPM limit caps the engine speed overshoot based on the predetermined RPM limit, and thus caps the vessel speed overshoot. Thereby, the adapted RPM limit, once adapted in based on a previous launch cycle, reduces the RPM setpoint outputted by the wake surfer RPM controller 120 for aggressive launches.

The minimum output from comparator 130 is then compared to the requested RPM 106 at the comparator 140 and the minimum value is selected as the final RPM request 142. This last step ensures that the final RM request does not exceed maximum values for the engine or otherwise exceed maximum allowed values for the system, which is more likely to be limiting at an initial portion of the launch.

Figure 6:
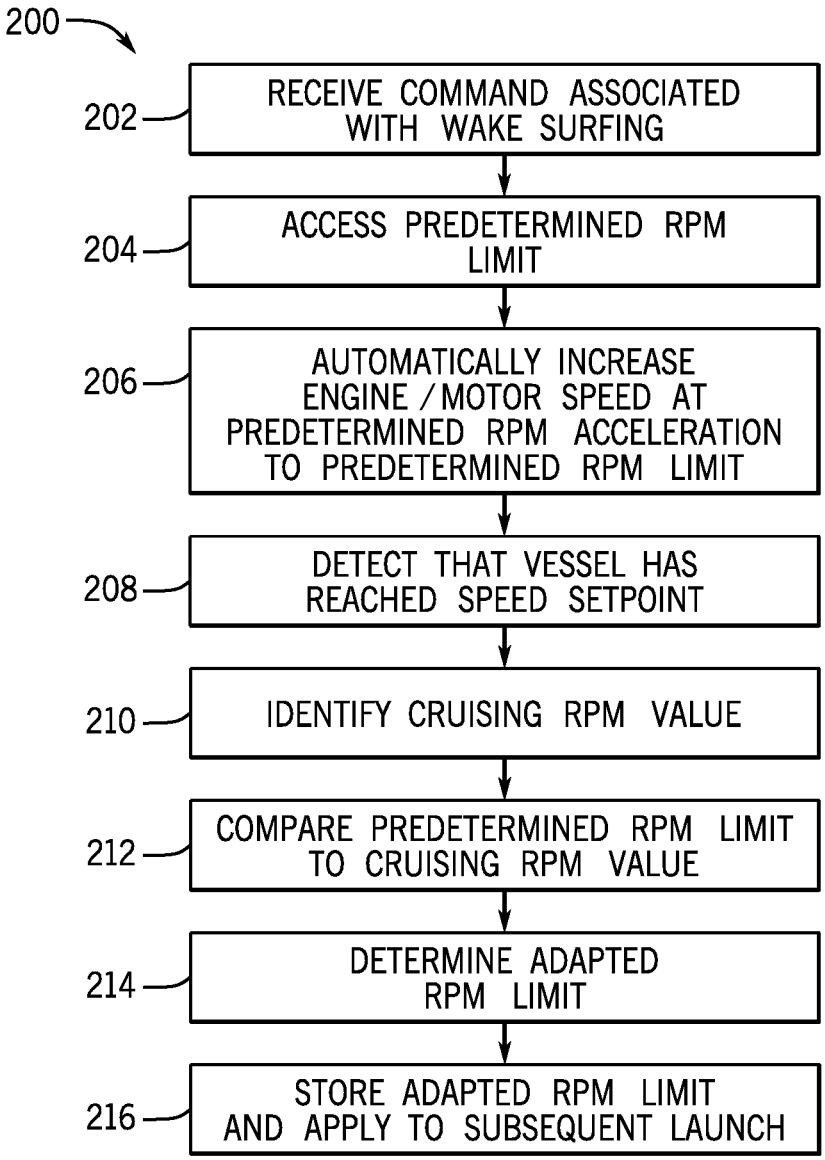
FIG. 6 is depicting one embodiment of a method of controlling propulsion for automated launch control according to one embodiment of the present disclosure.

FIG. 6 depicts one embodiment of a method 200 of automatically controlling propulsion for automated launch control. A user-selected command associated with wake surfing is received at step 202. A predetermined RPM limit is accessed at step 204 based on the user-selected command, such as the selected launch profile. Other examples of user-selected commands are described above. The engine speed is then automatically increased at step 206 to accelerate the marine vessel to a vessel speed setpoint. The engine speed is increased so that it does not exceed a predetermined RPM limit. For example, the RPM may be accelerated at a predetermined acceleration rate all the way to the RPM limit.

Vessel speed is monitored, such as based on from the vessel speed sensor 14, to detect when the vessel has reached the vessel speed setpoint at step 208. The cruising RPM value is then determined at step 210. Various methods may be utilized to determine the cruising RPM value associated with the marine vessel traveling at the vessel speed setpoint.

U.S. Pat. No. 9,682,760, which has been incorporated herein, exemplifies and describes embodiments of methods of systems for learning an RPM associated with a particular vessel speed.

The predetermined RPM limit is then compared to the cruising RPM value at step 212, such as to determine difference therebetween. An adapted RPM limit is then determined at step 214 based on the comparison, such as based on the difference. The adapted RPM limit is stored at step 216. It can then be applied in a subsequent launch and the vessel overshoot for that subsequent launch will decrease.

This written description uses examples to disclose the invention, including the best mode, and also to enable any person skilled in the art to make and use the invention. Certain terms have been used for brevity, clarity and understanding. No unnecessary limitations are to be inferred therefrom beyond the requirement of the prior art because such terms are used for descriptive purposes only and are intended to be broadly construed. The patentable scope of the invention is defined by the claims, and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

We claim:

1. A method of controlling propulsion for automated launch control of a marine vessel, the method comprising:

receiving a user-selected command associated with wake surfing;

accessing a predetermined RPM limit associated with the user-selected command;

automatically increasing rotational speed of a powerhead to accelerate the marine vessel to a vessel speed setpoint such that the rotational speed does not exceed the predetermined RPM limit;

detecting that the marine vessel is traveling at the vessel speed setpoint;

identifying a cruising RPM value associated with the marine vessel traveling at the vessel speed setpoint;

determining a difference between the predetermined RPM limit and the cruising RPM value;

adjusting the predetermined RPM limit to an adapted RPM limit based on the difference; and storing the adapted RPM limit for use during a subsequent launch.

2. The method of claim 1, wherein automatically increasing the rotational speed to accelerate the marine vessel to the vessel speed setpoint includes accelerating the engine to the predetermined RPM limit based on a predetermined RPM acceleration.

3. The method of claim 2, wherein the predetermined RPM acceleration is based on a user-selected launch profile.

4. The method of claim 3, wherein the predetermined RPM limit is further associated with at least one of the selected launch profile and the vessel speed setpoint.

5. The method of claim 1, wherein the method further includes accelerating the engine to the adapted RPM limit during a subsequent launch.

6. The method of claim 5, wherein the engine is accelerated to the adapted RPM limit at a predetermined RPM acceleration based on a user-selected launch profile.

7. The method of claim 6, further comprising, prior to accelerating the engine to the adapted RPM limit, determining that the predetermined RPM acceleration is at least a threshold acceleration.

8. The method of claim 5, wherein the adapted RPM limit is less than the predetermined RPM such that RPM overshoot is decreased during the subsequent launch.

9. The method of claim 1, wherein the user-selected command associated with wake surfing includes selection of a vessel speed between 8 and 15 miles per hour as the vessel speed setpoint.

10. The method of claim 1, wherein the user-selected command associated with wake surfing includes selection of surfing control mode to engage automatic propulsion control for wake surfing.

11. The method of claim 1, wherein adjusting the predetermined RPM limit to the adapted RPM limit includes adjusting the predetermined RPM limit by a percentage of the difference.

12. The method of claim 1, wherein adjusting the predetermined RPM limit to the adapted RPM limit includes adjusting the predetermined RPM limit by a predetermined amount in the direction of the difference, wherein the predetermined amount is less than or equal to the difference.

13. A marine propulsion system on a marine vessel comprising:

a propulsion device configured to exert a propulsion force on the marine vessel;

a user interface configured to receive at least one user-selected command for controlling launch of the marine vessel;

a control system configured to:

receive the user-selected command associated with wake surfing;

access a predetermined RPM limit based on the user-selected command;

automatically control the propulsion device to increase rotational speed to accelerate the marine vessel to a vessel speed setpoint such that the rotational speed does not exceed the predetermined RPM limit;

detect that the marine vessel is traveling at the vessel speed setpoint;

identify a cruising RPM value associated with the marine vessel traveling at the vessel speed setpoint;

determine a difference between the predetermined RPM limit and the cruising RPM value;

adjust the predetermined RPM limit to an adapted RPM limit based on the difference; and store the adapted RPM limit for use during a subsequent launch.

14. The system of claim 13, wherein the user-selected command for controlling launch includes at least one of a user-selected launch profile associated with wake surfing and selection of a vessel speed associated with wake surfing as the vessel speed setpoint.

15. The system of claim 14, wherein the control system is further configured to accelerate the engine to the predetermined RPM limit at a predetermined RPM acceleration based on the user-selected launch profile.

16. The system of claim 13, wherein the predetermined RPM limit is further associated with at least one of the selected launch profile and the vessel speed setpoint.

17. The system of claim 14, wherein the control system is further configured to accelerate the engine to the adapted RPM limit during a subsequent launch, the engine is accelerated to the adapted RPM limit at a predetermined RPM acceleration based on a user-selected launch profile for the subsequent launch.

18. The system of claim 17, wherein the control system is further configured to, prior to accelerating the engine to the adapted RPM limit for the subsequent launch, determine that the predetermined RPM acceleration is at least a threshold acceleration.

19. The system of claim 17, wherein the adapted RPM limit is less than the predetermined RPM such that RPM overshoot is decreased during the subsequent launch.

20. The system of claim 17, wherein the control system is further configured to adjust the predetermined RPM limit by a percentage of the difference to generate the adapted RPM limit.

* * * * *